US006942209B2

(12) United States Patent
Kawakami

(10) Patent No.: US 6,942,209 B2
(45) Date of Patent: Sep. 13, 2005

(54) SEPARATION MEMBER, AND SHEET FEEDING APPARATUS AND IMAGE PROCESSING APPARATUS USING THIS MEMBER

(75) Inventor: Shinya Kawakami, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 10/427,966

(22) Filed: May 2, 2003

(65) Prior Publication Data

US 2004/0032076 A1 Feb. 19, 2004

(30) Foreign Application Priority Data

May 8, 2002 (JP) ..... 2002-132511

(51) Int. Cl.[7] ..... B65H 3/52
(52) U.S. Cl. ..... 271/121; 271/167
(58) Field of Search ..... 271/121, 167, 271/117, 126, 127

(56) References Cited

U.S. PATENT DOCUMENTS 6,536,757 B2 * 3/2003 Chang ..... 271/16

FOREIGN PATENT DOCUMENTS

JP 04251048 A * 9/1992 ..... B65H/03/52
JP 05024694 A * 2/1993 ..... B65H/3/52

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

The present invention relates to a separation member in contact with a sheet for separating the sheet with frictional force, comprising plurality of protrusion members, each structured of a supporting portion upright from an operation surface for the sheet and a distal end portion formed at a distal end of the supporting portion capable of contacting to the sheet. The supporting portion of the protrusion member is inclined toward a downstream side in a sheet feeding direction with respect to a direction perpendicular to the operation surface of the sheet.

11 Claims, 10 Drawing Sheets

SEPARATION MEMBER, AND SHEET FEEDING APPARATUS AND IMAGE PROCESSING APPARATUS USING THIS MEMBER

BACKGROUND OF THE INVENTION

1. Field of the Intention

This invention relates to a roller member for conveying sheets by frictional force thereof in contact with the sheets and, more particularly, to a roller member capable of accurately conveying and separating the sheets even for the sheets in any size, and a sheet conveyance apparatus as well as an image forming apparatus such as a photocopier, a printer, a word processor, a facsimile machine, using this member.

2. Related Background Art

An example of a laser beam printer equipped with a conventional sheet feeding apparatus is shown in FIG. 10. This printer separately feeds one by one the sheets P contained in a sheet cassette 101 in a stacking manner by a feeding roller 102*a* as a sheet feeding apparatus and a roller 102*b* rotating integral with the feeding roller 102*a*, and a separation pad 108 capable of contacting to the feeding roller 102*a* or the roller 102*b*. The sheet is conveyed to the image forming section 106 including, e.g., a photosensitive drum 106*a* and a developing unit 106*b* by conveyance rollers 104*a*, 104*b* and registration rollers 105*a*, 105*b*, and the toner image formed at the image forming section 106 is transferred to be formed as image. The sheet P after the toner image is transferred is conveyed to a fixing unit 107 to fix thermally the toner image, and is delivered to A delivery portion 108.

The separation pad 103 is structured of an elastic member such as a rubber or the like in contact with the feeding roller 102*a*, and a surface 106 thereof is furnished with polishing processing or slicing processing in a direction perpendicular to the sheet feeding direction, thereby separating the recording sheet P with frictional characteristics.

The conventional sheet feeding apparatus described above however, raises the following problems. For example, where feeding force is set largely in aiming at a thick sheet of about 200 g/m$^2$, if a thin sheet of about 60 g/m$^2$ is tried to be fed, the sheets in a plural number are inevitably fed at the same time. To separate the sheets, some plans, are used such that pushing force exerted to the feeding roller 102*a* of the separation pad 103 is largely set to raise nipping pressure or that the separation pad 103 is made in use of a material having a higher frictional coefficient.

Even where the pushing force of the separation pad 103 is increased as described above, no effect is given except the nipping portion, so that considerably large pushing force is needed to operate separation function only by the nipping portion. Large drive force is therefore required for the feeding roller 102*a*, so that the drive motor is needed to have a large capacity, and so that this may raise a problem that extraordinary noises called as "screaming" tend to occur where the frictional force among the separation pad 103, the feeding roller 102*a*, and the roller 102*b* is strong.

In a case that a material having a high frictional coefficient is used for the separation pad 103, the fictional coefficient may be changed from wearing due to durable situation or the like, and therefore, this raises a problem that the feeding property may be dropped.

In addition, in a case of the separation pad 103 having a high frictional coefficient, a thin sheet fed from the feeding roller 102*a* way hit the separation pad 103 during conveyance of the thin sheet, thereby raising a problem that the sheet front end receives damages, or namely, "front edge folding" may occur.

Substantially the same phenomenon may occur in sheets being left under a high humidity circumstance and absorbing moisture during a sheet conveyance period for the sheets other than the thin sheets.

Moreover, there raises a problem that the separation performance may be dropped due to reduction of the frictional coefficient from attachments of paper powder.

SUMMARY OF THE INVENTION

This invention is accomplished in consideration of the problem described above. It is an object of the invention to provide a separation member having a good separation performance for a long period about various sheet materials from a thin sheet to a thick sheet including such as OHT, gross paper, and the like, ad a sheet feeding apparatus and an image forming apparatus having this separation member.

A representative structure according to the invention to accomplish the above object is a separation member in contact with a sheet for separating the sheet with frictional force, including a plurality of protrusion members, each structured of a supporting portion upright from an operation surface for the sheer and a distal end portion formed at a distal end of the supporting portion capable of contacting to the sheet, wherein the supporting portion of the protrusion member is inclined toward a downstream side in a sheet feeding direction with aspect to a direction perpendicular to the operation surface of the sheet.

DETAILED DESCRIPTION OF THE PREFERRED EMBODIMENTS

[First Embodiment]

Hereinafter, an embodiment of a feeding apparatus according to this invention is described with an example of a laser beam printer serving as an image forming apparatus in use of an electrophotographic method in which laser beam is scanned on a photosensitive drum to make recording.

[The Whole Structure]

Figure 1:
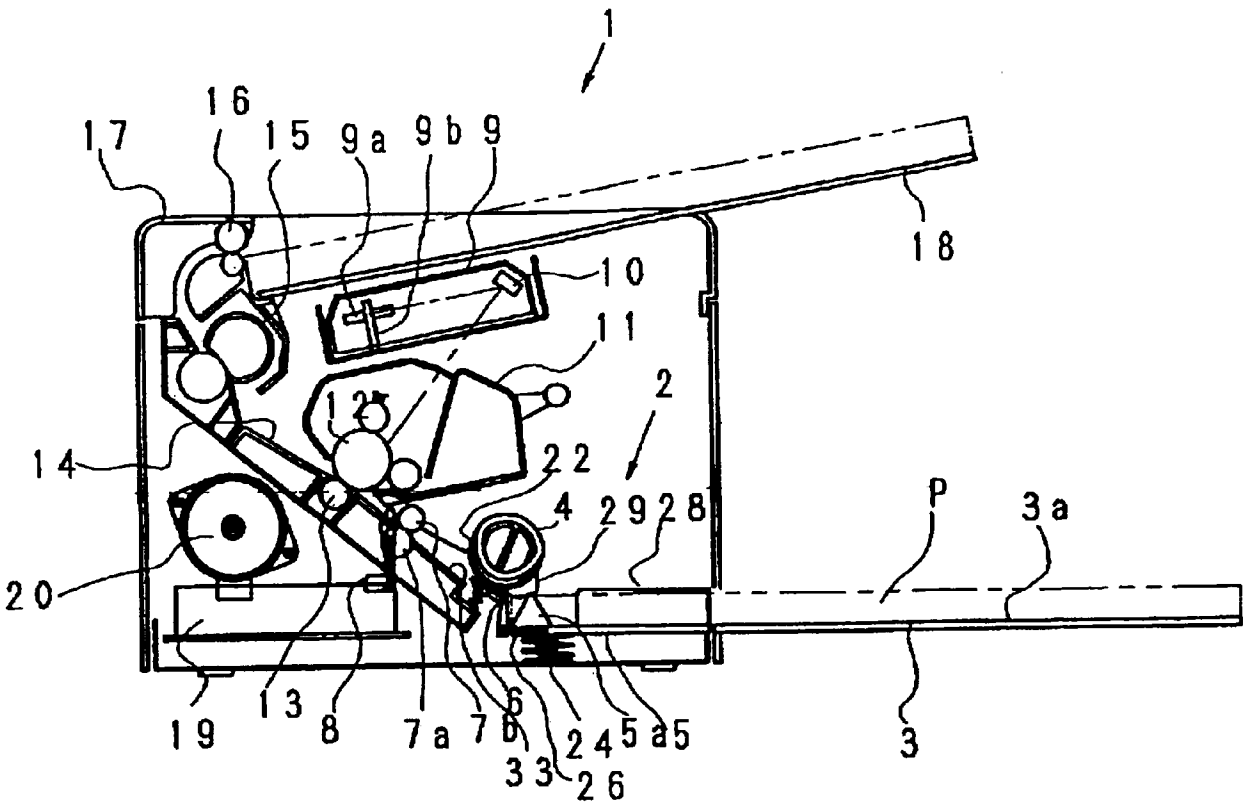
FIG. 1 is a cross section showing an essential portion of an image forming apparatus equipped with a feeding apparatus according to a first embodiment.
Figure 2:
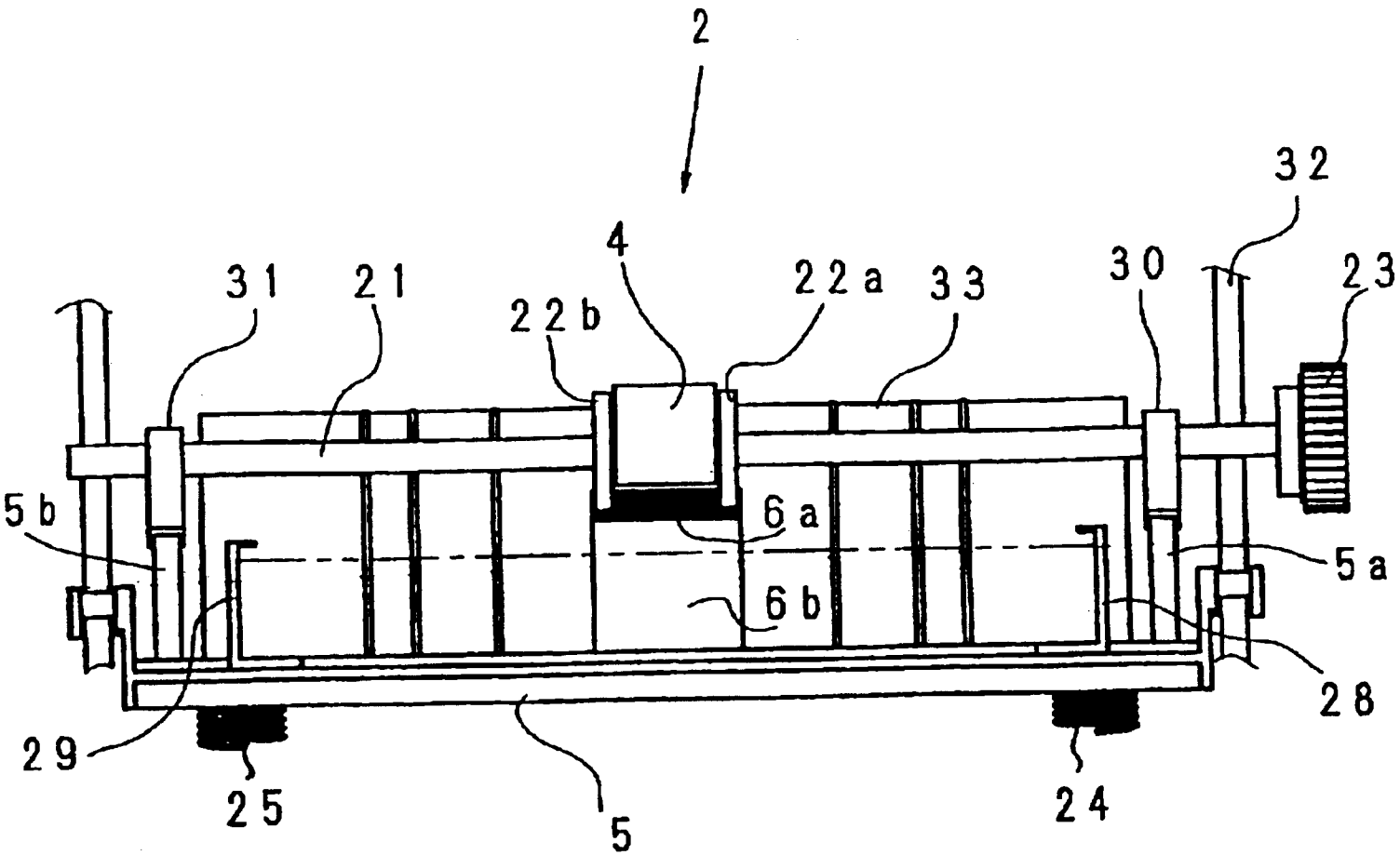
FIG. 2 is a substantially front view of the feeding apparatus according to the first embodiment.

FIG. 1 is a cross section showing an essential portion of an image forming apparatus 1 equipped with a feeding apparatus according to a first embodiment; FIG. 2 is a substantially front view of the feeding apparatus 2 according to the first embodiment.

An outlined structure of the laser beam printer of the embodiment is described as below.

In the drawings, numeral 3 is a feeding tray seam as a sheet staking means for stacking sheets P serving as sheets fed in the image forming apparatus, and sheets P are stacked on a sheet stacking surface 3*a* of the feeding tray 3. The sheet P its pushed by a pressure plate 5 as a pushing member to a feeding roller 4 as a feeding means disposed on an upper front end side of the feeding tray 3, and is picked up. The sheets P me separated and fed one by one with a separation pad unit 6 structuring the separating means and with the feeding roller 4, and are conveyed to a transfer section with the conveyance rollers 7*a*, 7*b* as a conveying means.

Numeral 8 is a registration server, which synchronizes emission timing of a laser scanner 9 as an exposure light source to the front end position of the sheet P, thereby depicting the images from a prescribed position on the sheet P. Numeral 10 is a returning mirror.

Numeral 11 is a process cartridge 11 as image forming means made of, e.g., a photosensitive drum 12, a developing unit, a cleaner, a charging roller; numeral 13 is a transfer roller for transferring emerged images on the photosensitive drum 12 to the sheet P; numeral 14 is a conveyance guide for guiding the transferred sheet P to the fixing unit 15; and the fixing unit 15 thermally fixes the emerged images on the sheet P. The sheet P is delivered onto a delivery tray 18 formed integral with an outer cover 17 by a delivery roller 16.

[About Sheet Conveyance Angle]

As shown in FIG. 1, the feeding apparatus 2 having the feeding roller 4, the pressure plate 5, and the separation pad unit 6, the transferring means for transferring the emerged images on the photosensitive drum 12 by the transfer roller 13 onto the sheet P, and the fixing unit 15 for thermally fixing the toner images on the sheet P are disposed substantially linearly as extending obliquely upward where the fixing unit 15 is located at the topmost position.

The sheet P stacked an the feeding tray 3 is conveyed to the transfer unit by the conveyance roller 7 along the substantially straight conveyance route after fed by the feeding roller 4, and is thereafter conveyed to the fixing unit 15 concurrently with the toner image transfer by the photosensitive drum 12 and the transfer roller 13 in a sandwiching manner. Because the conveyance route during this for the sheet P is substantially straight, frictional noises between the sheet P and the guide member during the sheet conveyance can be reduced, and the sheet P can be conveyed stably, so that the apparatus has a structure that reliability on the sheet conveyance can be improved.

The fixing unit 15 is disposed at the topmost location in the sheet conveyance route, and therefore, heats generated from the fixing unit 15, even where the printing operation is made successively, are discharged to the exterior of the apparatus out of the louver portion, not shown, formed in the outer cover 17, so that the apparatus can obtain always good output images without receiving any influence from the heats generated from the fixing unit 15 because the process cartridge 11 and the laser scanner 9 are disposed below or on a side of the fixing unit 15.

[Arrangement of the Laser Scanner]

The laser scanner 9 as shown in FIG. 1 is disposed on an upper left side with respect to a scanner polygon 9*a* as a unit location. To make compact the size of the image forming apparatus as much as possible, it is most effective to render the laser beam incident to the photosensitive drum 12 in a direction perpendicular to the sheet conveyance route from the feeding apparatus 2 via the transferring means to the fixing unit 15 as shown in FIG. 1. With such a structure, the depth and height of The image forming apparatus can be designed to the minimum size.

Because a scanner motor 9*b* rotating the scanner polygon mirror 9*a* is held substantially in a horizontal state, no load is exerted to a bearing of the scanner motor, so that any problem such that wearing of the bearing renders the duration of the scanner motor 9*b* short may not occur, so that the apparatus can be used for a long time.

With a structure shown in FIG. 1, the process cartridge 11 is detachably attached horizontally in a direction toward the feeding tray 3, and the jamming recovery in the image forming apparatus and replacement of the process cartridge 11 can be done in the same direction, so that the usability is much improved.

[About Electronic Equipment System Layout]

An electronic equipment unit 19 made of an AC power source, a DC, power source, and a high voltage power source is disposed below the sheet conveyance route directing an obliquely upper side from the feeding apparatus 2 to the bring unit 15 as shown in FIG. 1, and the space in the electronic equipment unit is structured to be wider from the feeding area to the fixing area. With this structure, a route of air flow generated by heats generated front the electronic equipment unit 19 is ensured.

Heats generated from the fixing unit 15 disposed at a top of the electronic equipment Sit 19 is exhausted to the exterior of the apparatus through a louver portion, not shown, formed in the outer cover 17. At that time, a space is formed between the rear surface of the fixing unit 15 and the outer cover 17, thereby producing air flow thereat form waste heats out of the fixing unit 15.

Accordingly, in forming the large space below the fixing unit 15 as described above, arranging the electronic equipment unit 19, and forming the space on the rear surface side of the fixing unit 15, air flow may be generated for waste heats from the electronic equipment unit 19 to the fixing unit 15 even where no fan or the like is provided for cooling purpose, so that heat remaining inside the image forming apparatus is cut out, and so that the apparatus prevents the temperature from increasing.

[About Arrangement of the Drive Source]

A motor 20 as a drive source is directly mounted on an inner side of a side wall as a part of the frame of the image forming apparatus as shown in FIG. 1, and attached with screws. The motor 20 is disposed below the sheet conveyance surface for feeding, transferring, and fixing.

Where the motor is disposed below the sheet conveyance portion this allows corresponding flexibly to larger motors and changes from a stepping motor to a DC motor when corresponding to faster operation of the image forming apparatus. This can accomplish easily a faster operation from, e.g., 10 ppm to 20 ppm.

Herein, the outline structure of the laser printer is described. Subsequently, the structure of the feeding apparatus 2 in this embodiment is described.

[About the Feeding Apparatus]

Figure 3:
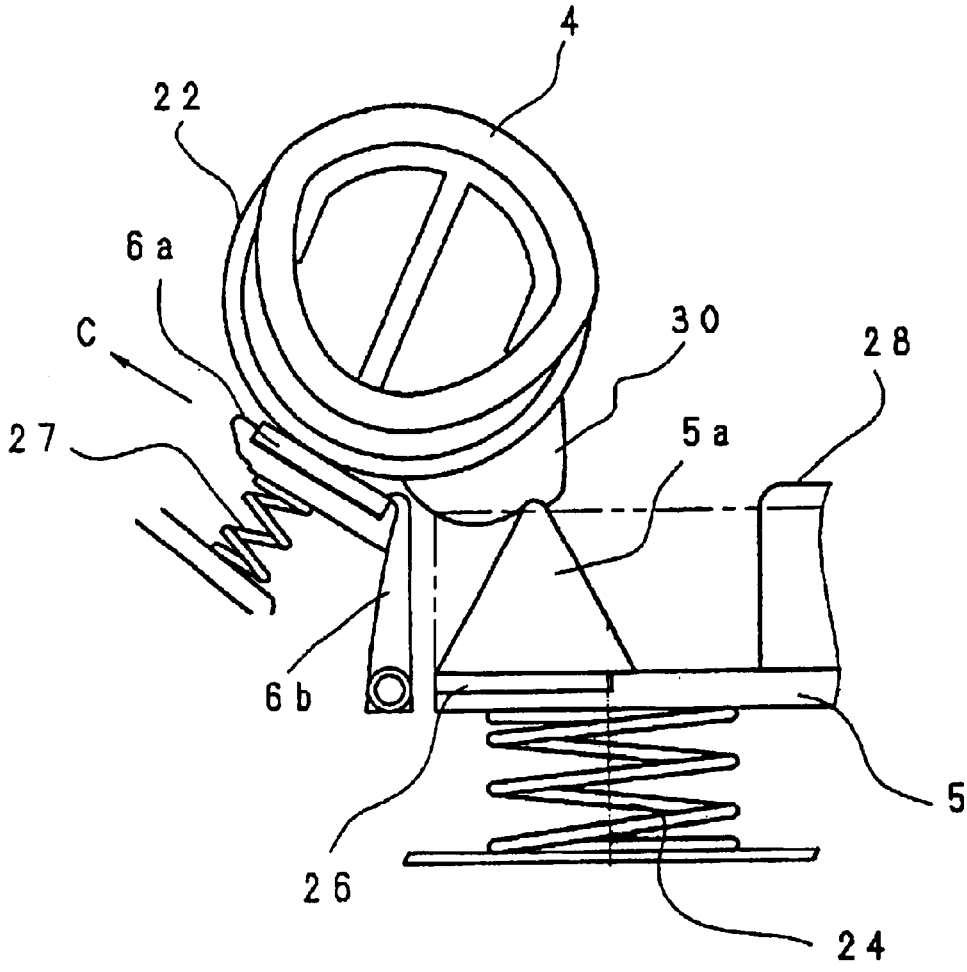
FIG. 3 is a cross section showing an essential portion of the feeding apparatus according to the first embodiment.
Figure 4:
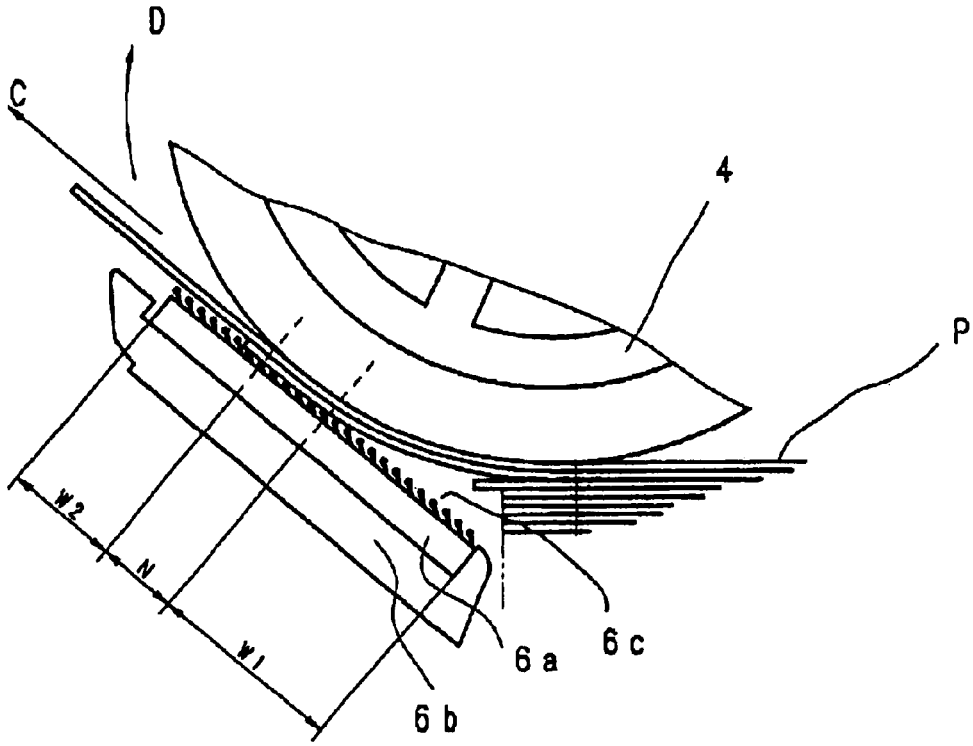
FIG. 4 is an illustration showing feeding operation in the feeding apparatus according to the first embodiment.

Next, a structure of the sheet feeding apparatus is described in detail. FIG. 3 is a cross section showing an essential portion of the feeding apparatus according to the first embodiment; FIG. 4 is a schematic part cross Portion showing the feeding apparatus 2.

As shown in FIG. 2, FIG. 3, the feeding roller 4 as a feeding meals is constituted of a half moon shape roller having a cross section in a letter D and a shaft 21. Rollers 22 (22*a*, 22*b*) held rotatably at the shaft 21 are formed at respective sides of the feeding roller 4. The rollers 22 is in a circular shape and has a diameter slightly smaller than the maximum outer shape of the feeding roller 4. A gear 23 exists on one end of the shaft 21. The feeding roller 4 rotates in reception of drive via the gear 23 from the motor 20.

The pressure plate 5 is urged by pressure spring 24, 25 and pushes the sheet P to the feeding roller 4 during feeding of the sheet P. The separation pad 26 is formed at a portion where the pressure plate 5 pushes the sheet P to the feeding roller 4. The separation sheet 26 is made of a caulk or synthetic word surface and has a frictional coefficient with respect to the sheet P of about 0.5 to 1.0, thereby contributing prevention of doubly feeding of the bottom most sheet in the sheets P on the pressure plate 5.

The separation pad 6 is structured of a separation pad 6*a* made of an elastic body for separating the fed sheets P to one sheet and a holder 6*b* for holding the separation pad 6*a*. The separation pad 6 is in contact with the feeding roller 22 with a pad spring 27 during the apparatus is in a waiting state.

Width regulating plates 28, 29 formed at the pressure plate 5 are movable in a sheet width direction in matching with the sheet size on the pressure plate Lo regulate the sheet width of the sheet P.

Cams 30, 31 are secured around the opposite ends of the sheet 21 and are in contact with cam portions 5*a*, 5*b* of the pressure plate 5. The cams 30, 31 while in an apparatus waiting state, urges the pressure plate 5 in opposing to the pressure spring 24, 25 so as not to render the sheet in contact with the feeding roller 4. The shaft 21 and the pressure plate 5 are rotatably held to the frame 32. Numeral 33 is a sheet guide from the feeding roller 4 to the conveyance roller 7.

[About Feeding Operation and Sheet Separation Property]

Figure 5A:
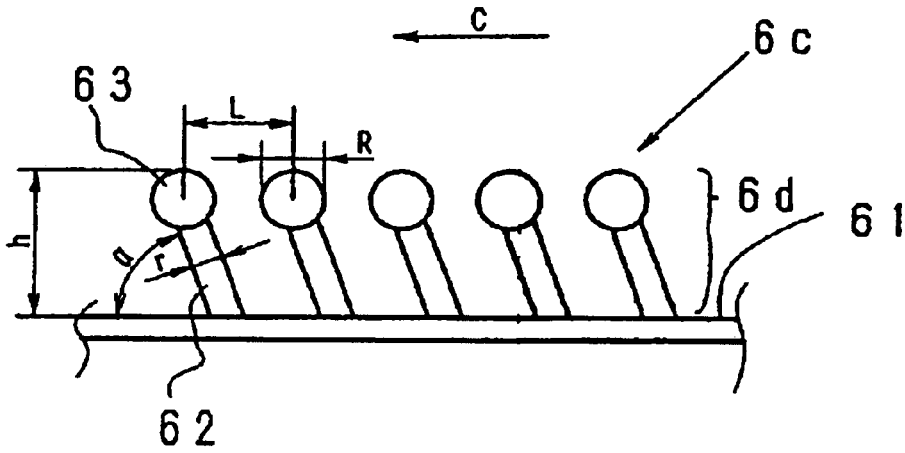
FIG. 5, which consists of FIGS. 5A and 5B, is an illustration showing a separation pad of the feeding apparatus according to the first embodiment.
Figure 5B:
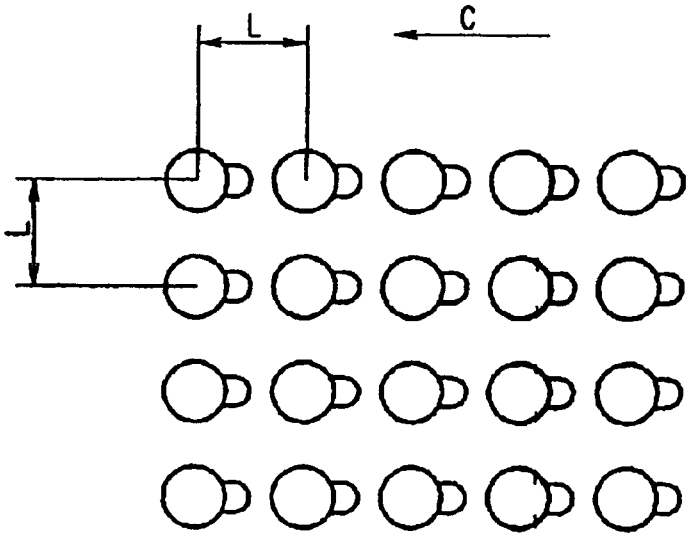
Figure 6A:
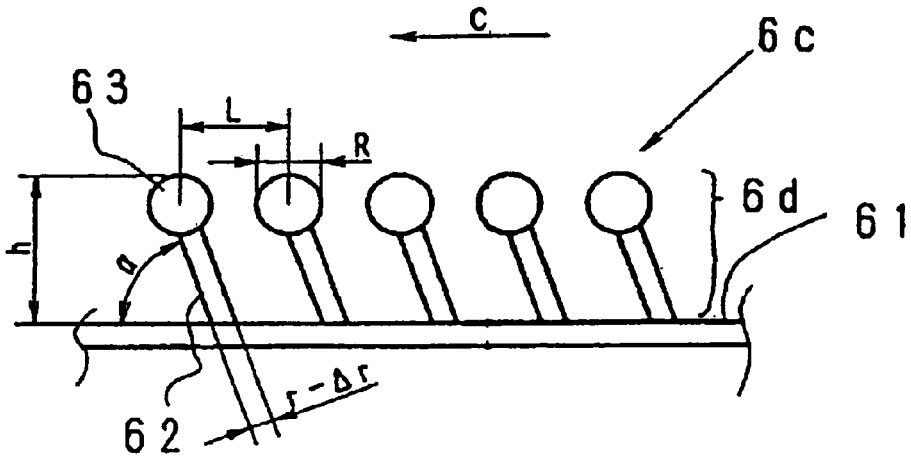
FIG. 6, which consists of FIGS. 6A and 6B, is an illustration showing the separation pad of the feeding apparatus according to the first embodiment.
Figure 6B:
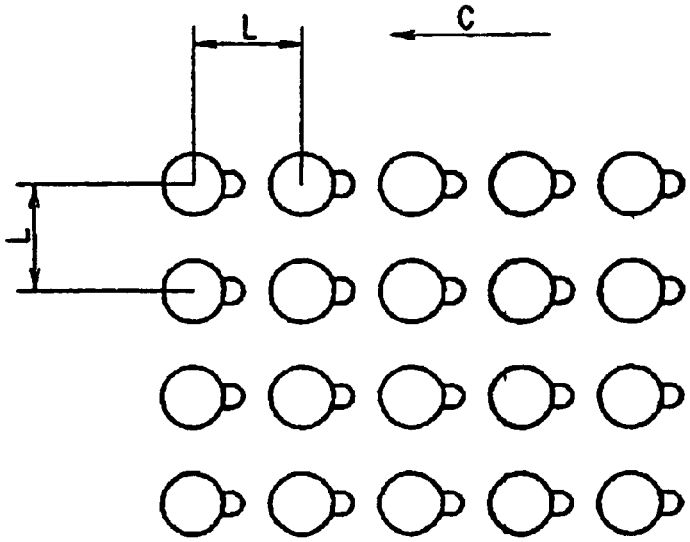
Figure 7A:
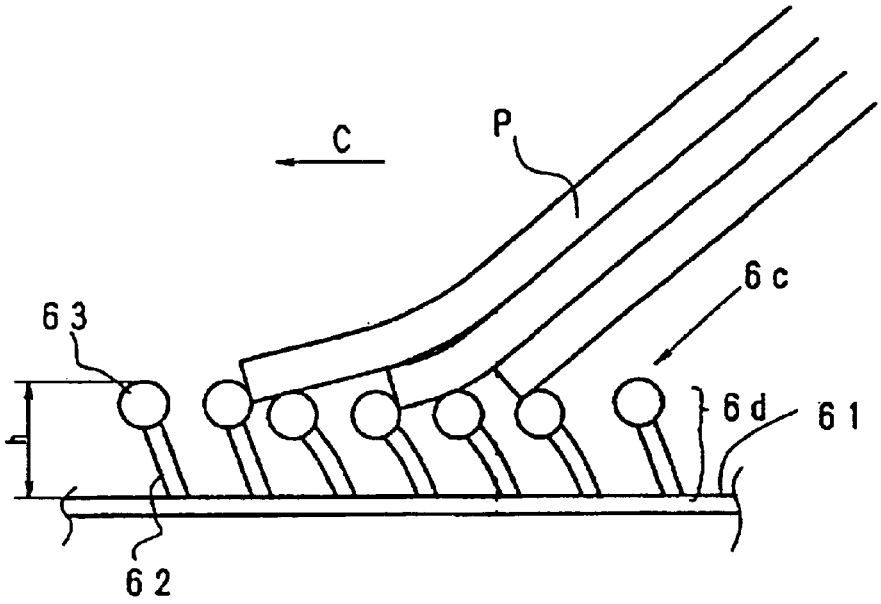
FIG. 7, which consists of FIGS. 7A and 7B, is an illustration showing the separation pad of the feeding apparatus during the feeding operation according to the first embodiment.
Figure 7B:
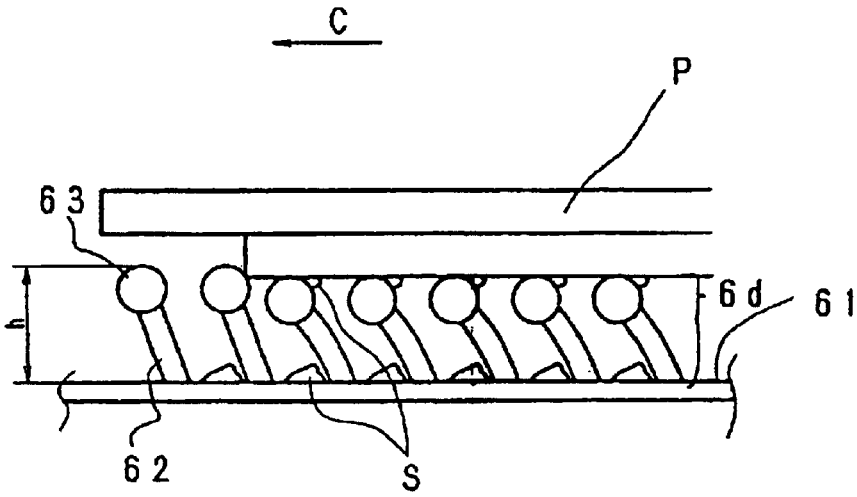

Referring to FIG. 4 through FIG. 7, the feeding operation and the feature of the separation pad unit 6 are described. It is to be noted that: FIG. 4 is a partly cross section during feeding operation of the sheet feeding apparatus; FIG. 5 and FIG. 6 are enlarged views of the separation pad 6*a* used for the sheet feeding apparatus. FIG. 7 is an enlarged operation diagram of the separation pad 6*a* during the feeding operation of the sheet feeding apparatus.

The feeding roller 4 receives drive force via the gear 23 from the motor 20 and rotates in a direction of arrow D in FIG. 4. The cams 30, 31 of the pressure plate 5 are stopped urging the pressure plate 5 according to the rotation of the feeding roller 4, and the pressure plate 5 pushes the sheet P with force of the pressure springs 24, 25 to the feeding roller 4. The sheets P in a several number around a top of the sheets P in contact with the feeding roller 4 are conveyed by the feeding roller 4, and subsequently, are separated to one sheet P in contact with the feeding roller 4 with the separation pad 6*a* of the separation pad unit 6.

FIG. 5 shows a detail of the nipping portion N of the separation pad 6*a* and the separation pad surface 6*c* in a downstream side range W2 in the sheet feeding direction (hereinafter, simply referred to as "downstream side range") with respect to the nipping portion N; FIG. 6 shows a detail of the separation pad surface 6*c* in an upstream side range W1 in the sheet feeding direction (hereinafter, simply referred to as "upstream side range").

Numeral 6*d* is a three-dimensional structural body as a fine protrusion member on the separation pad 6*a* and is structured of a supporting portion 62 and a distal cad portion 63. This three-dimensional structural body 6*d* is made of the cylindrical supporting portion 62 (in this embodiment, having a cylindrical shape of diameter r) upright from an elastic base 61 as a sheet operation surface of the invention, and a spherical distal end portion 63 (in this embodiment, having a spherical shape of diameter R where r<R) formed At a tip of the supporting portion, thereby forming the body in a mushroom shape with a height in a range of 1 to 500 micron meters.

The supporting portion 62 is formed in a way slant with an angle alpha with respect to the elastic base 61 toward the sheet feeding direction. The distal cad portion 63 is a spherical shape of a diameter R and is formed with a distance L micron meters to the adjacent three-dimensional structural bodies 6*d* as arranged orderly in the sheet feeding direction as well as a direction perpendicular to the sheet feeding direction.

The three-dimensional structural body 6*d* in this embodiment is structured of an ether based urethane resin of the same material as the elastic base 61. It is to be noted that as a usable material for the elastic base 61, exemplified are natural rubber, ethylene-propylene rubber (EPR), ethylene-propylene-diene rubber (EPDM), styrene-butadiene rubber (SBR), butyl rubber (IIR), silicone rubber, urethane rubber, etc., and caulk, butyl-isopropyl-ethylene rubber, etc.

The supporting portion 62 in the nipping portion N of the separation pad 6*a* and the downstream side range W2 is in the cylindrical shape of diameter r, and the supporting portion 62 in the upstream side range W1 is in the cylindrical shape of diameter $(r-\Delta r)$. Here, a formula $r>r-\Delta r$ is satisfied. That is, the supporting portion 62 of the upstream side range W1 is thinner than the supporting portion in the downstream side range W2, so that the elastic force is made smaller by that portion.

FIG. 7(*a*) shows a contact state between the separation pad in the upstream side range W1 of the separation pad and the recording sheet P. FIG. 7(*b*) shows a contact state between the separation pad in the nipping portion N as well as the downstream side range W2 and the recording sheet P.

Where the recording sheets P of two sheets or more are conveyed by the conveyance roller 1, the front and of the recording sheet P first enters in the upstream side range W1 of the separation pad. At that time, the front and hits the digital and portions of 63 the three-dimensional structural body 6*d* of the separation pad. Because the diameter of the supporting portion 62 is designed to be smaller by $\Delta r$ than the diameter r of the supporting portion 62 set so as to be obtain necessary separation frictional force at the nipping portion and the downstream side range W2, the three-dimensional structural body 6*d* is elastically transformed properly in a sheet feeding direction (arrow C direction) in association with entry of the recording sheet. Because the distal end is in a spherical shape, this does not give abrupt resistance to the front end of the recording sheets, so that the recording sheets can be separated in preventing the recording sheets from receiving damages at the front end such as "front edge folding" or the like.

With the recording sheet of a plural number conveyed to the downstream side as not separated completely in the upstream side range W1, as shown in FIG. 7(*b*), the recording sheets in contact with the feeding roller at the nipping portion N are conveyed in arrow C direction, and the recording sheets on the downstream side are held on the separation pad by the friction between the distal end portion 63 of the three-dimensional structural body 6*d* and the recording sheet. At that time, where the frictional coefficient among further overlapping recording sheets is large, the sheets tend to be conveyed in arrow C direction. In such a case, however, the front end of the recording sheet hits the distal end portions 63 of the three-dimensional structural body, and because the supporting portions 62 at the nipping portion and the downstream side range W2 have the adequate elastic force to separate the sheets, the sheets are prevented from being doubly fed.

As described above, with the separation pad 6*a* in this embodiment, the distal end 63 of the three-dimensional structural body 6*d* during a series of separation operations always obtains a constant contact area to any recording sheet having any physical property including the weight per unit area, so that the frictional force exerted to the recording sheet P is made stable, thereby improving the separation performance. Thus, the pushing force by the pad spring 27 of the Separation pad unit 6 can be set lower than that of the conventional example, thereby reducing the friction of the separation pad 6*a*, and improving the durability. The separation pad 6*a* can be made of a rubber material or the like having a high resistance against wearing, and since the required drive torque for the feeding roller can be made smaller in comparison with the conventional structure, the sheet feeding apparatus having excellent durability and stable separation property can be provided with reduced costs.

When the sheet is separated, as shown in FIG. 7(*b*), even where foreign objects S such as paper powder or the like are attached to the sheet P, the foreign objects may not be attached to the distal end portion 63 because dropping to the elastic base 61, so that the objects do not affect the sheet separation force. Accordingly, the stable separation feature is maintained for, a long time.

Where the recording sheet is entered with a deep angle with respect to the surface of the separation pad 6*a*, the front end of the recording sheet may not be engaged with the three-dimensional structural body, so that the recording sheet may not receive any damage, and so that the stable separation performance is obtained.

With this apparatus, the materials can be selected widely regarding the rubber material of the separation means and the rubber material of the pushing portion of the pushing means, so that this apparatus can enjoy a high performance separation operation even in use of an inexpensive, highly durable rubber material, an that the feeding apparatus of such a high performance can be provided with a lower price.

[Second Embodiment]

Next, a separation pad of a second embodiment is described. It is to be noted that the differences only from those in the first embodiment are described herein, and others are omitted.

Figure 8A:
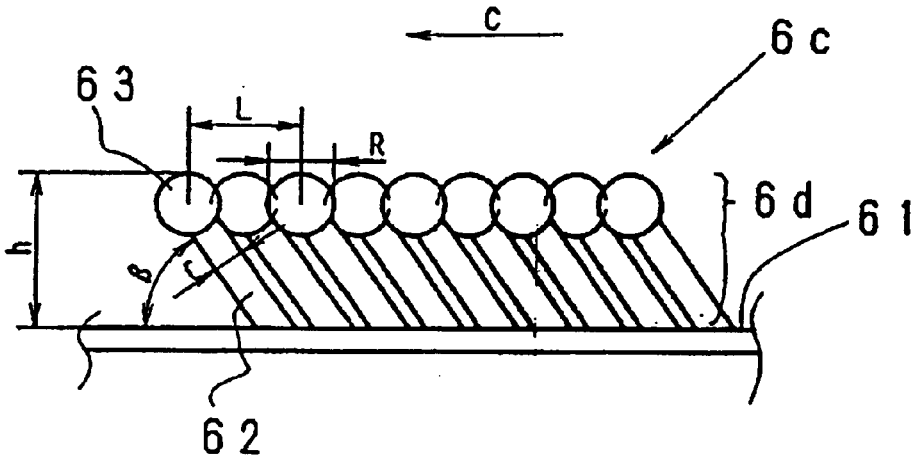
FIG. 8, which consists of FIGS. 8A and 8B, is an illustration showing a separation pad of the feeding apparatus according to a second embodiment.
Figure 8B:
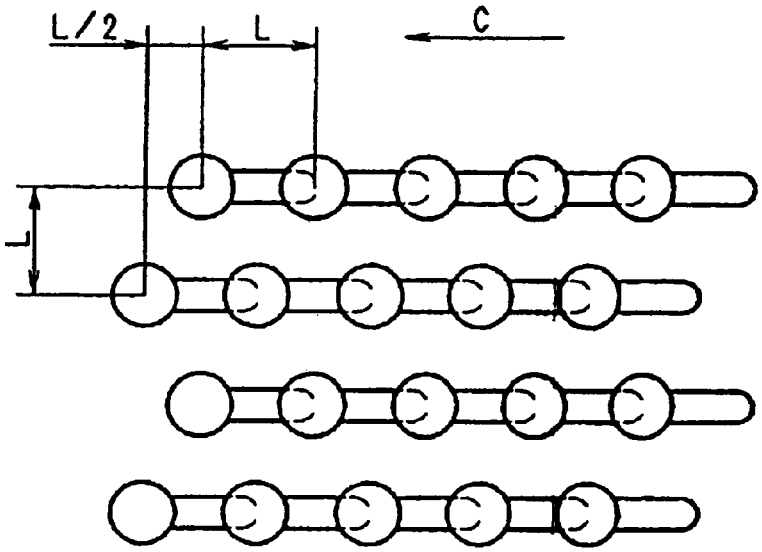

FIG. 8 is an structural enlarged view the upstream side range W1 of the separation pad 6*a* used for the sheet feeding apparatus according to the second embodiment; FIG. 8 is an structural enlarged view the upstream side range W1 of the separation pad 6*a* during feeding operation of the sheet feeding apparatus.

Numeral 6*d* is a three-dimensional structural body on the separation pad 6*a* and is made of a supporting portion 62 and a distal end portion 63. The supporting portion 62 is in a cylindrical shape having a diameter r and is formed as inclined with an angle β in directing the downstream side in the sheet feeding sir with respect to the elastic base 61. The angle β is set smaller than the inclined angle α in the first embodiment described above (β>α).

The distal end portion 63 is in a spherical shape having a diameter of R micron meters and is formed with a distance L micron meters to the adjacent three-dimensional structural bodies as arranged orderly in the sheet feeding direction but with a distance L micron meters in a direction perpendicular to the sheet feeding direction su shifted by L/2 in the sheet feeding direction, to form an arrangement of three-dimensional structural bodies in a staggered form.

It is to be noted that the three-dimensional structural body 6*d* is formed with an ether based urethane rubber as the same material as the elastic base 61 in substantially the same way as in the first embodiment.

It is to be noted that the shapes of the three-dimensional structural body 6*d* of the nipping portion N of the separation pad 6*a* and of the separation pad 6*a* in the downstream side range W2 are the same shape as that in the first embodiment, and the arrangement is the same as the staggered arrangement of the three-dimension structural bodies 6*d* in the upstream side range W1.

Figure 9:
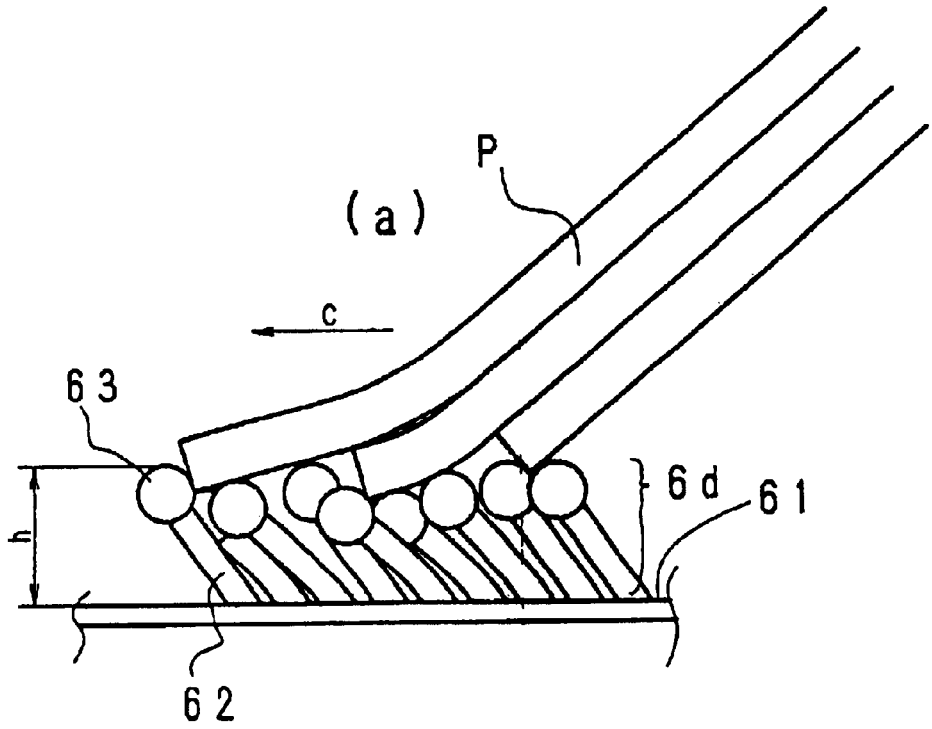
FIG. 9 is an illustration showing the separation pad of the feeding apparatus during the feeding operation according to the second embodiment.
Figure 10:
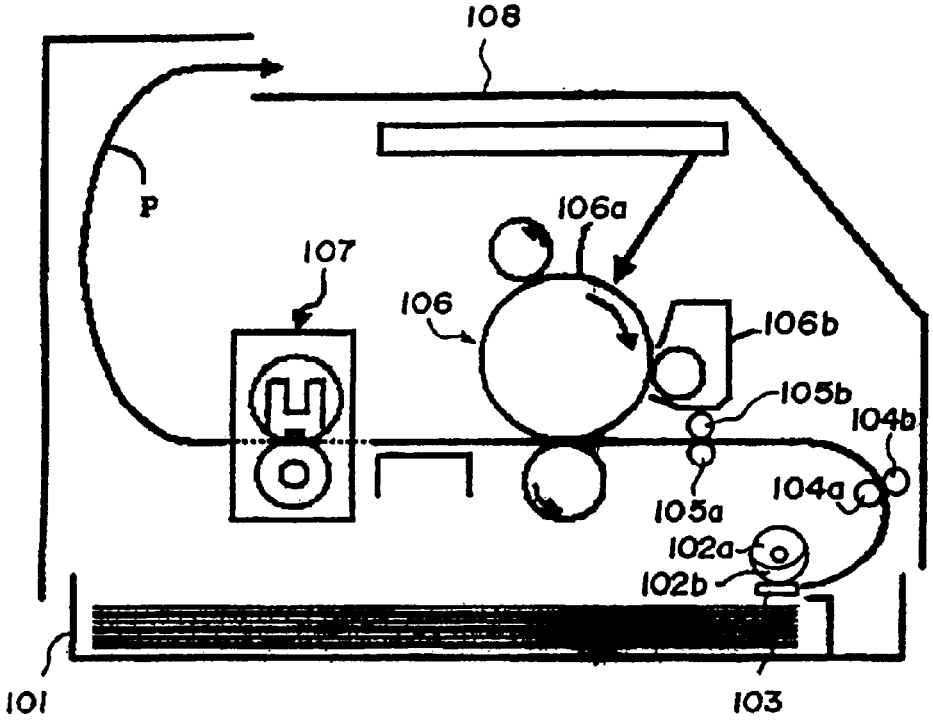
FIG.10 PRIOR ART
FIG. 10 is a cross section showing essential portion of an image forming apparatus equipped with a feeding apparatus as a prior art.

With the separation pad 6*a* of the above structure, where the recording sheets P of two sheets or more arc conveyed by the feeding roller 1, the front end of the recording sheet first enters in the upstream side range W1 of the separation pad as shown FIG. 9. At that time, the front end hits the distal end portion 63 of the three-dimensional structural body 6*d* of the separation pad. Because the angle β of the supporting portion 62 is set smaller than the angle α of the supporting portion 62 so designed as to have a necessary separation friction force at the nipping portion, no abrupt resistance is given to the recording sheet front end when the recording sheet P is entered, thereby allowing separation of the recording sheets in preventing surely the recording sheets from receiving damages at the front end such as "front edge folding" or the like.

Where the entering angle of the recording sheet to the separation pad is changed to a direction extending further, perpendicular to the separation pad surface due to curling at the front end of the recording sheets, a problem such that the recording sheet front end digs into a portion on an upstream side of the three-dimensional structural body, or namely "turning" may not occur, because the three-dimensional structural bodies 6*d* are in the staggered form in the sheet feeding direction, so that the sheets can be guided toward the downstream side.

[Other Embodiments]

In the second embodiment, the three-dimensional structural bodies 6*d* are disposed in a staggered manner, but in the first embodiment the three-dimensional structural bodies 6*d* ran be disposed in a staggered manner. In the above embodiments, setting the shape of the supporting portion of the protrusion member to an arbitrary setting value according to kinds of the recording sheets to be fed can do a stable feeding.

Although in the above embodiments the supporting portion 62 of the three-dimensional structural bodies 6*d* is the cylindrical shape, any of a hollowed cylindrical shape, elliptic cylindrical shape, a polygonal prism shape, a cone shape, a elliptical cone shape, and a polygonal pyramid shape, is useable for the supporting portion. The distal end portion 63 is in the spherical shape, but can be in a shape of a half moon shape, a disc shape, a cone shape, and the like.

Although in the above embodiment the distance between the adjacent three-dimensional structural bodies 6*d* and the shape of the distal end portion 63 are set constant, those can be formed in various shapes. With such a structure, resonance of vibrations of the respective three-dimensional structural bodies occuring from frictional contacts among the separation pad, the feeding roller, and the recording sheet can be suppressed, and amplification of extraordinary noises can be prevented Although in the above embodiments the example in which the sheet feeding apparatus is used for the image forming apparatus is shown, this apparatus can be used not only for image forming apparatuses but also for apparatuses having another sheet feeding mechanism, e.g., a reading apparatus such as a scanner having an image reading means for reading information upon conveying an original document.

What is claimed is:

1. A separation member in contact with a sheet for separating the sheet with frictional force, comprising:

a plurality of protrusion members, each structured of a supporting portion upright from an operation surface for the sheet and a distal end portion formed at a distal end of the supporting portion capable of contacting to the sheet, wherein the distal end of the protrusion member is in any of a spherical shape, a disc shape, a cone shape, or an elliptical cone shape and the supporting portion of the protrusion member is inclined toward a downstream side in a sheet feeding direction with respect to a direction perpendicular to the operation surface of the sheet.

2. The separation member according to clam 1, wherein the protrusion member has the supporting portion formed on an upstream side range in a sheet feeding direction having an elastic force smaller than an elastic force of the supporting portion formed on a downstream side range.

3. The separation member according to claim 2, wherein the supporting portion of the protrusion member is formed in a cylindrical shape, and the protrusion member formed on the upstream side range in the sheet feeding direction has a diameter smaller than a diameter of the supporting portion of the protrusion member formed on the downstream side range.

4. The separation member according to claim 1, wherein the protrusion member formed on the upstream side range in the sheet feeding direction has an inclined angle smaller than an inclined angle of the protrusion member formed on the downstream side range.

5. The separation member according to claim 1, wherein the protrusion members are disposed in a staggered arrangement on the operation surface for the sheet.

6. The separation member according to claim 1, wherein the protrusion members are in a mushroom shape with a height of 1 to 500 micron meters.

7. The separation member according to claim 1, wherein the supporting portion of the protrusion member is in any of a cylindrical shape, a hollowed cylindrical shape, an elliptic cylindrical shape, a polygonal prism shape, a cone shape, an elliptical cone shape, and a polygonal pyramid shape.

8. A sheet feeding apparatus comprising:

a feeding roller providing feeding force to a sheet; and a separation member pushing the sheet to the feeding roller, wherein the separation member is as set forth in any of claims 1 to 6 and claim 7.

9. A sheet feeding apparatus comprising:

a feeding roller providing feeding force to a sheet;

a separation member pushing the sheet to the feeding roller; and a plurality of protrusion members, each structured of a supporting portion upright from an operation surface for the sheet at the separation member and a distal end portion formed at a distal end of the supporting portion capable of contacting to the sheet, wherein the distal end of the protrusion member is in any of a spherical shape, a disc shape, a cone shape, or an elliptical cone shape and the supporting portion of the protrusion member is inclined toward a downstream side in a sheet feeding direction with respect to a direction perpendicular to the operation surface of the sheet.

10. An image processing apparatus comprising:

either of an image processing means for processing on a sheet; and a sheet feeding apparatus for conveying the sheet to the image processing means, the sheet feeding apparatus comprising:

a feeding roller providing feeding force to a sheet; and a separation member pushing the sheet to the feeding roller, wherein the separation member is as set forth in any of claims 1 to 6 and claim 7.

11. An image processing apparatus comprising:

an image processing means for processing on a sheet; and a sheet feeding apparatus for conveying the sheet to the image processing means, the sheet feeding apparatus comprising:

a feeding roller providing feeding force to a sheet;

a separation member pushing the sheet to the feeding roller; and a plurality of protrusion members, each structured of a supporting portion upright from an operation surface for the sheet at the separation member and a distal end portion formed at a distal end of the supporting portion capable of contacting to the sheet, wherein the distal end of the protrusion member is in any of a spherical shape, a disc shape, a cone shape, or an elliptical cone shape and the supporting portion of the protrusion member is inclined toward a downstream side in a sheet feeding direction with respect to a direction perpendicular to the operation surface of the sheet.

* * * * *

UNITED STATES PATENT AND TRADEMARK OFFICE

CERTIFICATE OF CORRECTION

PATENT NO. : 6,942,209 B2
DATED : September 13, 2005
INVENTOR(S) : Shinya Kawakami It is certified that error appears in the above-identified patent and that said Letters Patent is hereby corrected as shown below:

Title page,
Item [56], References Cited, FOREIGN PATENT DOCUMENTS,
"04251048 A" should read -- 4-251048 A --; and
"05024694 A" should read -- 5-024694 A --.
Item [57], ABSTRACT,
Line 3, "comprising plurality" should read -- comprising a plurality --.

Column 1,
Line 24, "pad 108" should read -- pad 103 --.
Line 32, "A" should read -- a --.
Line 45, "plans," should read -- plans --.

Column 2,
Line 1, "way" should read -- may --.
Line 20, "ad" should read -- and --.

Column 3,
Line 17, "seam" should read -- serving --.
Line 18, "staking" should read -- stacking --.
Line 21, "its" should read -- is --.
Line 24, "me" should read -- are --.
Line 54, "after fed" should read -- after being fed --.

Column 4,
Line 16, "The" should read -- the --.
Line 32, "DC," should read -- DC --.
Line 35, "bring" should read -- fixing --.
Line 41, "Sit" should read -- unit --.
Line 45, "form" should read -- forming --.
Line 63, "flexibly" should read -- flexibility --.

Column 5,
Line 8, "Portion" should read -- section --.
Line 11, "meals" should read -- means --.
Line 14, "is" should read -- are --.
Line 15, "has" should read -- have --.
Line 32, "during" should read -- while --.
Line 35, "Lo" should read -- to --.
Line 40, "urges" should read -- urge --.
Line 48, "partly" should read -- partial --.

UNITED STATES PATENT AND TRADEMARK OFFICE

CERTIFICATE OF CORRECTION

PATENT NO. : 6,942,209 B2
DATED : September 13, 2005
INVENTOR(S) : Shinya Kawakami It is certified that error appears in the above-identified patent and that said Letters Patent is hereby corrected as shown below:

Column 6,
Lines 8 and 20, “cad” should read -- end --.
Line 14, “At” should read -- at --.
Line 18, “way slant” should read -- way that slants --.
Line 49, “and” should read -- end --.
Line 55, “be” should be deleted.

Column 7,
Line 24, “Separation” should read -- separation --.
Line 52, “an” should read -- so --.
Lines 59 and 62, “view the” should read -- view of the --.

Column 8,
Line 26, “arc” should read -- are --.
Line 63, “a” (1st occurrence) should read -- an --.

Column 9,
Line 57, “elliptic” should read -- elliptical --.

Column 10,
Lines 6 and 36, “claims 1 to 6 and claim 7.” should read -- claims 1 to 7. --.

Signed and Sealed this

Third Day of January, 2006

JON W. DUDAS
*Director of the United States Patent and Trademark Office*